United States Patent [19]

Horvay

[11] 4,008,579

[45] Feb. 22, 1977

[54] APPARATUS FOR HEAT CONTROL OF A REFRIGERATION SYSTEM

[75] Inventor: Julius B. Horvay, Louisville, Ky.

[73] Assignee: General Electric Company, Louisville, Ky.

[22] Filed: July 31, 1975

[21] Appl. No.: 600,772

[52] U.S. Cl. ..... 62/183; 165/32; 165/105

[51] Int. Cl.² ..... F25B 39/04

[58] Field of Search ..... 62/452, 453, 527, 183, 62/208; 165/105, 32

[56] References Cited

UNITED STATES PATENTS

| | | | |
|---|---|---|---|
| 2,067,959 | 1/1937 | Wasson | 236/49 UX |
| 3,363,430 | 1/1968 | White | 62/183 |
| 3,378,449 | 4/1968 | Roberts et al. | 165/105 X |

*Primary Examiner*—William E. Wayner

*Attorney, Agent, or Firm*—Steven C. Schnedler; Francis H. Boos

[57] ABSTRACT

A heat pipe for controlling the temperature of a refrigeration system of a refrigerator is of a general "U" configuration. A means is provided within the heat pipe to terminate the passage of gas and/or liquid through the heat pipe when the ambient temperature of the second end of the heat pipe is greater than the temperature of the portion of the refrigerator contacting the first end of the heat pipe.

5 Claims, 2 Drawing Figures

APPARATUS FOR HEAT CONTROL OF A REFRIGERATION SYSTEM

BACKGROUND OF THE INVENTION

Heat transfer apparatus known as heat pipes have been developed for transferring large amounts of heat with a small temperature drop. These heat pipes are of an efficiency which makes them the equivalent of a material having a thermo-conductivity greatly exceeding that of any known material. These heat pipes can be of various construction, for example of pipe construction of segmented pipe construction, having wicking or capillary elements positioned therein.

As is known in the art, the heat pipe can be utilized for transferring heat from the compressor or the condenser of a refrigerator to a mullion of the refrigerator as shown in U.S. Pat. No. 1,992,011—Knight.

Owing to the increasing attempts to conserve energy, it was discovered that the power requiements of a household refrigerator could be reduced by increasing the efficiency of dissipating the heat rejected by the refrigeration system. However, in increasing the efficiency of the refrigerator, it is desirable to transfer the heat from a portion of the refrigerator to a location outside the apartment, house, or other structure within which the refrigerator is used. This transfer of heat to the outdoors is particularly desirable during cold months where the temperature in the room where the refrigerator is located is considerably greater than the ambient temperature outside the house. As this temperature differential increases, heat from the refrigerator system is more readily removed by the heat pipe system thereby resulting in an increase in the efficiency of the refrigeration system.

For transferring the heat outdoors, it is necessary to provide a passageway through an outside wall of the house or apartment for extending the heat pipe therethrough. In order to provide a neat, non-objectionable opening, it is preferable that the opening be positioned immediately adjacent the floor. This positioning of the heat pipe created another problem in the construction of the heat pipe system.

The condensers of household refrigerators are generally positioned two or three feet above the bottom of the refrigerator. This made it necessary to construct the heat pipe which contained a wicking structure for the movement of the condensed liquid of the heat pipe upwardly to a position adjacent the condenser.

Since heat pipes of general U configuration are not inherently unidirectional in the transfer of heat, it then becomes necessary to provide means for terminating operation of the heat pipe during periods when the outside ambient temperature is greater than the temperature of the portion of the heat pipe associated with the condenser.

The system of this invention provides means for more efficiently operating a household refrigerator while overcoming the problems as set forth above.

SUMMARY OF THE INVENTION

In accordance with this invention, a heat pipe is utilized for controlling the temperature of a refrigeration system positioned within a house. The heat pipe is of general U configuration and has a middle and first and second leg portions. The first leg portion is positioned in heat exchange relationship with a heat source of the refrigeration system. The middle portion of the heat pipe passes through a wall of the house. The second leg portion is positioned outside the house. A valve is positioned between the first and second leg portions of the heat pipe for controllably isolating the first leg portion of the heat pipe.

DETAILED DESCRIPTION OF THE INVENTION

Figure 1:
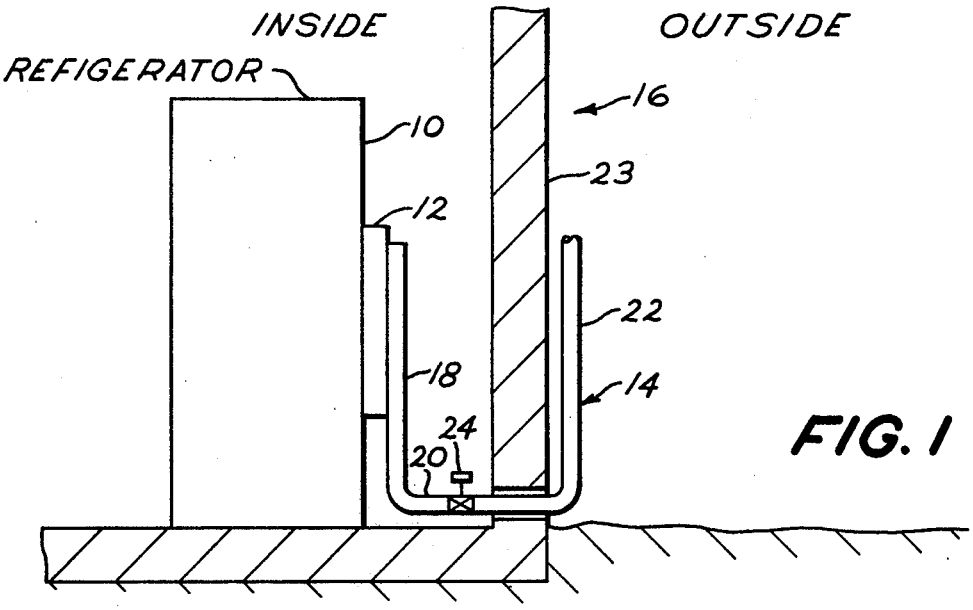
FIG. 1 is a diagrammatic view of the apparatus of this invention.

In the embodiment of FIG. 1, a refrigeration system of a household refrigerator 10, for example, has a condenser 12. A heat pipe 14 of general U configuration is associated with the condenser 12 of the refrigerator 10 for removing heat from the condenser 12.

It should be understood that the heat pipe 14 can be in heat exchange relationship with any heat source of the refrigeration system, the controlled cooling of which would improve the operational efficiency of said refrigeration system. The heat source elements of the refrigeration system are the compressor and the above-identified condenser 12. In order to simplify the description of this invention, the condenser 12 will hereafter be utilized as the example heat souce.

The refrigerator 10 is positioned within a house, apartment, or other structure 16. The heat pipe 14 has a middle and first and second leg portions 20, 18, 22. The first leg portion 18 is positioned in heat exchange relationship with the condenser 12 of the refrigerator 10 and preferably extends downwardly therefrom. The middle portion 20 passes through an outside wall 23 of the house 16. The second leg portion 22 is positioned outside the house 16 and preferably extends upwardly from the middle portion 20. The second leg portion 22 is therefore exposed to the outside ambient temperature.

A valve 24 is positioned between the first and second leg portions 18, 22 of the heat pipe 14 for isolating the first leg portion 18 from the second leg portion 22 of the heat pipe 14.

Figure 2:
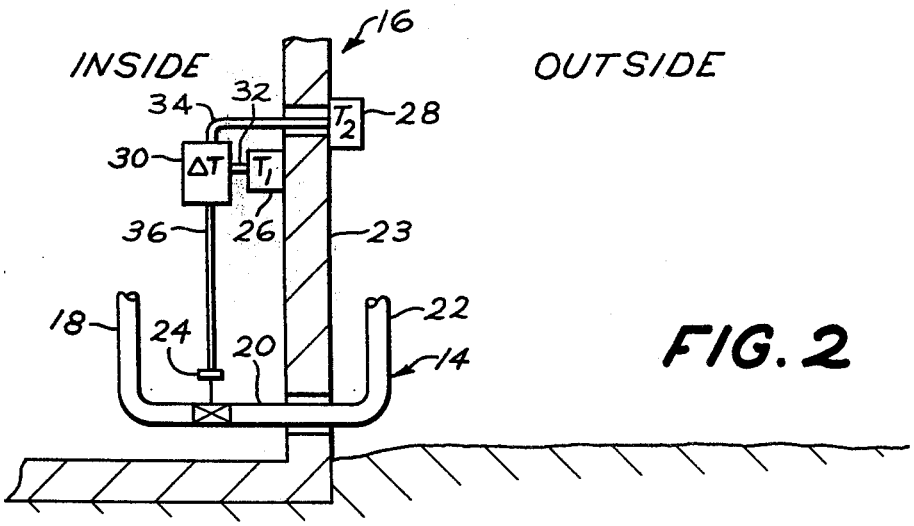
FIG. 2 is a diagrammatic view of another embodiment of this invention.

In the embodiment of FIG. 2, the valve 24 is a control valve. A first temperature measuring-signalling element 26 is positioned within the house 16 and a second temperature measuring-signalling element 28 is positioned outside the house 16.

Both of the temperature measuring-signalling elements 26, 28 are connected to controller 30 via respective lines 32, 34. Controller 30 is connected via line 36 to the control valve 24 for moving the control valve between an open and a closed position in response to a signal delivered by the ratio controller 30 representative of the difference between the measured temperatures. This valve control system can be a pneumatic, hydraulic or electrical system, as is known in the art.

In the operation of the apparatus, heat is transferred by the heat pipe 14 from the condenser 12 through the house 16 and is discharged into the atmosphere outside the house 16 during those operational periods when the outside temperature is a value less than the value of the temperature inside the house 16.

The valve 24 can be closed to isolate the first leg of the heat pipe when the outside temperature is greater than the temperature inside the house 16. As described above, the valve 24 can be manually controlled as shown in FIG. 1 of automatically controlled as shown in FIG. 2. Closing of the valve prevents transfer of heat between first and second leg portions by the fluid within the heat pipe.

By utilizing the heat pipe system of this invention, undesirable heat is transferred outside the house which provides improved efficiency and temperature control of the refrigerator. Further, the valve means prevents the transfer of heat into the house and the condenser during periods of high temperature outside the house.

Other modifications and alterations of this invention will become apparent to those skilled in the art from the foregoing discussion, and it should be understood that this invention is not to be unduly limited thereto.

What is claimed is:

1. Apparatus for controlling the temperature of a refrigeration system of a refrigerator positioned within a house, said apparatus comprising:

a heat pipe of general U configuration having middle and first and second leg portions, said first leg portion being in heat exchange relationship with the refrigeration system, said middle portion passing through a wall of the house, and said second leg portion being outside the house for passing heat from the refrigeration system to a location outside the house;

a control valve positioned between said first and second heat pipe leg portions for controllably isolating said first leg portion from said second leg portion; and means for moving the control valve between an open and a closed position in response to the difference between the temperatures outside and inside the house.

2. Apparatus, as set forth in claim 1, wherein said means for moving the control valve opens the control valve when the inside temperature is greater than the outside temperature, and closes the control valve when the outside temperature is greater than the inside temperature.

3. Apparatus, as set forth in claim 1, wherein the first and second legs of the heat pipe extend generally upwarrdly from the middle portion of the heat pipe.

4. Apparatus for controlling the temperature of a refrigeration system of a refrigerator positioned within a house, said apparatus comprising:

a heat pipe having middle and first and second leg portions, said first leg portion being in heat exchange relationship with the refrigeration system, said middle portion passing through a wall of the house, and said second leg portion being outside the house for passing heat from the refrigeration system to a location outside the house;

a control valve positioned between said first and second heat pipe leg portions for controllably isolating said first leg portion from said second leg portion; and means for moving the control valve between an open and a closed position in response to the difference between the temperatures outside and inside the house.

5. Apparatus, as set forth in claim 4, wherein said means for moving the control valve opens the control valve when the inside temperature is greater than the outside temperature, and closes the control valve when the outside temperature is greater than the inside temperature.

* * * * *